US005845415A

United States Patent [19]

Sundqvist

[11] Patent Number: 5,845,415

[45] Date of Patent: Dec. 8, 1998

[54] METHOD FOR IMPINGEMENT DRYING AND/OR THROUGH-DRYING OF A PAPER OR MATERIAL WEB

[75] Inventor: Hans Sundqvist, Turku, Finland

[73] Assignee: Valmet Corporation, Helsinki, Finland

[21] Appl. No.: 878,547

[22] Filed: Jun. 19, 1997

[30] Foreign Application Priority Data

Jun. 19, 1996 [FI] Finland ..... 962551

[51] Int. Cl.[6] ..... D21F 5/00

[52] U.S. Cl. ..... 34/452; 34/456; 34/463

[58] Field of Search ..... 34/452, 453, 454, 34/456, 460, 463, 487, 120, 122, 124, 125, 634, 635, 638, 643, 649

[56] References Cited

U.S. PATENT DOCUMENTS

| | | | |
|---|---|---|---|
| 3,447,247 | 6/1969 | Daane | 34/634 X |
| 3,763,571 | 10/1973 | Vits | 34/57 A |
| 3,982,328 | 9/1976 | Gustafsson et al. | 34/156 |
| 4,361,466 | 11/1982 | Wong et al. | 162/207 |
| 4,551,203 | 11/1985 | Eskelinen | 162/202 |
| 5,070,627 | 12/1991 | Zagar | 34/156 |
| 5,105,558 | 4/1992 | Curry | 34/449 |
| 5,210,958 | 5/1993 | Bond et al. | 34/18 |
| 5,471,766 | 12/1995 | Heikkilä et al. | 34/461 |
| 5,588,223 | 12/1996 | Marshall | 34/414 |

FOREIGN PATENT DOCUMENTS

| | | |
|---|---|---|
| 0561256 | 9/1993 | European Pat. Off. . |
| 55881 | 11/1975 | Finland . |
| 2020430 | 12/1971 | Germany . |

*Primary Examiner*—Henry A. Bennett
*Assistant Examiner*—Steve Gravini
*Attorney, Agent, or Firm*—Steinberg & Raskin, P.C.

[57] ABSTRACT

A method and apparatus for impingement drying and/or through-drying of a paper or material web in which the web is dried by blowing hot air and/or superheated steam and/or equivalent from an impingement drying device in a direction substantially perpendicular to the web, and the web is passed on support of a wire or equivalent past the impingement drying device. In the area of the impingement drying device, the web and wire are supported from the opposite side of the wire, opposite in relation to the web, by blowings produced from vacuum blow box substantially across the entire width of the web. One set of blowings from the blow box are blown at a speed substantially higher than the speed of the drying wire. The outlet direction of the blowings is substantially the same as the running direction of the drying wire in this area, and as such, steam and/or air is/are ejected out of the space between the drying wire and the wall placed in connection with the blow boxes that produce the blowings. A second set of blowings from the blow boxes are blown in the direction opposite to the running direction of the wire so as to seal the area of vacuum between the wire and the blow box. Substantially the same medium may be used as the blow medium in the blow box as is used in the impingement drying device.

21 Claims, 1 Drawing Sheet

METHOD FOR IMPINGEMENT DRYING AND/OR THROUGH-DRYING OF A PAPER OR MATERIAL WEB

FIELD OF THE INVENTION

The present invention relates to a method for impingement drying and/or through-drying of a paper web or an equivalent web-like material in which the paper web or the equivalent web-like material is dried by blowing hot air and/or superheated steam and/or an equivalent medium by means of an impingement drying device in a direction substantially perpendicular to the paper web or the equivalent web-like material. Also, the paper or material web is passed on support of a wire or equivalent past the impingement drying device.

The present invention also relates to a device for impingement drying and/or through-drying of a paper web or an equivalent web-like material which comprises an impingement drying and/or through-drying device(s) whereby the web to be dried is arranged to pass on support of a wire or equivalent over the drying device(s).

BACKGROUND OF THE INVENTION

It is known in the prior art to use various impingement-drying/through-drying units for evaporation drying of a paper web. In these units, the paper web is dried so that, by means of the impingement drying devices, hot air or superheated steam is blown in a direction substantially perpendicular to the paper at a relatively high speed. In these constructions, the paper web or equivalent web-like material often runs on support of a wire, roll, cylinder or equivalent support member. With respect to the prior art constructions related to evaporation drying of a paper web and based on impingement drying, reference is made to U.S. Pat. No. 4,361,466, which describes a web drying method and apparatus that employ hot air, and to U.S. Pat. No. 5,210,958, which describes an apparatus and method for drying a paper web in which superheated steam is employed.

As known in the prior art, the use of superheated steam as the drying medium is more advantageous than the use of hot air, because in such a case it is also possible to utilize the hot moisture separated from the web. When paper is dried by means of superheated steam, it is known in the prior art to use devices in which the paper web runs on support of a wire and in which, at the side of the paper web, an impingement dryer is placed which includes blow openings for steam and exhaust openings for the return steam. The area of the impingement dryer has been formed as a closed space by means of an enclosure such as a hood. Inside the enclosure, there can also be several separate dryers. The closed space in the interior of the enclosure is usually filled with steam whose temperature is somewhat higher than 100° C. Compared with conventional impingement drying processes provided with an impingement drying hood, an advantage of an enclosed arrangement is that the number of potential leakage points is minimized to two, i.e., the point at which the paper web is passed into an interior of the enclosure and the point at which the paper web is passed out of the interior of the enclosure.

The prior art constructions involve, among other things, the drawback that, with such an enclosure, there should not occur any web breaks or equivalent in the interior of the enclosure, because entering into the interior of the enclosure for repair and/or maintenance operations requires a time-consuming process of emptying the interior of steam and a period of cooling of the equipment and, after the maintenance or cleaning, a long start-up period, during which period the air must be removed and the equipment is heated to the operational temperature, which in itself lowers the capacity of the equipment and causes undue expenses.

In the prior art constructions, the paper web often runs on support of a wire, and the web is kept in contact with the wire by means of a difference in pressure across the wire. The drying-air jets of the impingement drying are in themselves insufficient for producing this difference in pressure because the process between the nozzle face and the paper is somewhat dynamic, in which connection the paper web can be separated from the wire.

In the prior art, mechanical seals have been suggested as a solution, which seals permit the maintaining of a certain difference in pressure between the top and bottom portions of the enclosure. However, mechanical seals are not favorable because they drag against the wire and thus wear the wire. Further, the use of mechanical seals has the consequence that the difference in pressure must be maintained over the length of the entire enclosure from the inlet opening of the paper to the outlet opening, because cross-direction additional seals for maintaining a difference in pressure make the equipment considerably more complex. For this reason, at the inlet and outlet openings of the enclosure, there is a pressure above the wire and/or a vacuum below the wire. However, this can result in leakage of steam out of the enclosure above the wire or in flow of air into the enclosure below the wire at the openings if the sealing arrangement of the openings for the web is not fully sealed.

Further, alignment of a mechanical seal is difficult, because the seal must coincide with the edge of the paper web with adequate precision, which is very difficult to accomplish under production conditions. If leakage occurs through the wire outside the edges of the paper web, the result is a reduced difference in pressure or a steam flow from the top side to the bottom side.

Besides sealing, further important factors in applications of impingement drying of a paper web or an equivalent web-like material, from the point of view of runnability, include the keeping or maintenance of the web substantially straight and the constant distance of the web from the blow devices. In order to control the running of the web, it is known to use a suction box placed underneath the wire, but the faces of the suction box that drag against the wire as well as the exhaust suction produced by the suction box cause problems for the runnability of the web and affect its stability on the face of the wire.

With respect to the prior art related to the present invention, reference is also made to the current assignee's Finnish Patent No. 67,107 (corresponding to U.S. Pat. No. 4,551,203) which describes an arrangement for passing a paper web from the press section into the dryer section, in which, to the side of the drying wire that supports the web, a number of air jets are blown at a speed substantially higher than the speed of the drying wire. The outlet direction of these jets is substantially the same as the running direction of the drying wire at that location, and air is ejected by means of this blowing of air out of the space placed between the drying wire and the wall placed in connection with the members that produce the air jets. In this arrangement, blow boxes are employed, which are positioned on the run of the drying wire at the side of the wire, which extend substantially across the entire width of the web and include one or more nozzle slots. In the blow boxes, the walls placed facing the run of the drying wire are plane (flat) and substantially parallel to the run of the drying wire.

OBJECTS AND SUMMARY OF THE INVENTION

An object of the present invention is to provide a construction by whose means, in impingement drying, in particular in an arrangement in which the drying medium is superheated steam, the runnability of the web can be secured.

It is a further object of the invention to provide a construction in which the problems and drawbacks described above in connection with prior art web drying constructions do not occur.

It is another object of the present invention to provide a new and improved method and device for impingement drying and/or through-drying of a paper or material web.

In view of achieving the objects stated above and others, in the method in accordance with the invention, in the area of the impingement drying device, the web and the wire are supported from the opposite side of the wire, opposite in relation to the web side of the wire, by the intermediate of blowings produced by means of a vacuum blow box/boxes substantially across or along the entire width of the web. One set of blowings from the vacuum blow box(es) are blown at a speed substantially higher than the speed of the drying wire. The outlet direction of the blowings is substantially the same as the running direction of the drying wire in that area, i.e., in opposed relationship to the impingement drying and/or through drying device(s). By means of the first blowings, steam and/or air is/are ejected out of the space between the drying wire and the wall placed in connection with the blow boxes that produce the jets. The second set of blowings or jets produced by means of the blow box(es) are blown in the direction opposite to the running direction of the wire so as to seal the area of vacuum between the wire and the blow box. In the method, it is possible to use substantially the same medium as the blow medium in the blow box as is used in the impingement drying unit.

The device in accordance with the invention comprises a vacuum blow box/boxes for supporting the web and the wire by means of blowings produced by means of the vacuum blow box/boxes substantially across the entire width of the web. The blow medium in the vacuum blow box/boxes is substantially the same medium as the blow medium in the impingement-drying/through-drying unit/units.

In accordance with the invention, at the opposite side of the paper web or an equivalent web-like material and the wire, opposite in relation to the impingement dryer, one or more vacuum blow boxes are placed, i.e., blow devices by whose means a vacuum is produced below the wire (the web being supported above the wire). These vacuum blow devices generate the necessary difference in pressure across the wire, in which connection the paper web remains in contact with the wire and the runnability thereof is secured.

In the present invention it has been realized, in a novel manner with a view toward securing the runnability of a web, to combine an impingement drying application with vacuum blow boxes, by whose means the keeping and maintaining of the web on the wire is secured and by whose means, at the same time, the desired distance of the web from the impingement drying devices and the control of this distance can be achieved, in which connection the efficiency of evaporation can also be controlled. In this manner, by means of the arrangement in accordance with the invention, the desired draw of the paper web through the enclosure in the impingement drying unit is achieved.

By means of the arrangement in accordance with the invention, a sealing arrangement free of contact is achieved, in which there are no faces that drag against the wire or against the paper web. The blower in the system of runnability in accordance with the invention can also be used for emptying the enclosure from steam in a running-down situation, for example, for maintenance, and for evacuating air during a start-up procedure without having to use separate devices.

When the web is dried by means of superheated steam, steam is used as the blow medium in the vacuum blow devices, which steam is preferably taken from the interior of the enclosure, primarily from below the wire (on the side of the wire on which the blow devices are situated) in order that disturbing flows should not arise in the vertical direction in the enclosure. If necessary, in the steam supply line for the blow boxes there is a heating device, for example a steam heat exchanger or a direct supply of fresh steam, so as to maintain a suitable temperature level and thus, to eliminate any risk of condensation of the steam. In connection with the arrangement in accordance with the invention, it is also preferable to apply a system of control of runnability and steam status, wherein, by means of a blower, steam is also sucked from above the paper web and the wire and the same amount of steam is fed back to this area above the web after it has been heated. In order to maintain the temperature level in the enclosure, the heating device provided in the system of runnability is probably adequate, and no other heating or supply of steam into the enclosure is needed.

In a most basic embodiment of the method for impingement drying and/or through-drying of a paper or material web in accordance with the invention, a blow medium of hot air and/or superheated steam is blown from an impingement and/or through drying device in a direction substantially perpendicular to the web to dry the web and the web is passed in contact with a first side of a wire past the drying device. A wall extending across substantially the entire width of the web is arranged in opposed relationship to the drying device on a second side of the wire and faces the second side of the wire. An area of negative pressure is then generated in a space between the wire and the wall to cause the web to be pressed against the wire and thereby secure the runnability of the web over the drying device. The wall may be an upper wall of a vacuum blow box having first and second nozzles such that the area of negative pressure is generated by directing first blowings of a blow medium along substantially the entire width of the web from the first nozzle arranged at a first end of the wall in an outlet direction which is substantially the same as a running direction of the wire and at a speed substantially greater than the speed of the wire. This serves to eject steam and/or air from the space between the wire and the wall. Also, to seal the space between the wire and the wall, second blowings of a blow medium are directed from a second nozzle arranged at a second end of the wall opposed to the first end of the wall in a direction opposite to the running direction of the wire.

In the following, the invention will be described in more detail with reference to the figures in the accompanying drawings. However, the invention is not strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
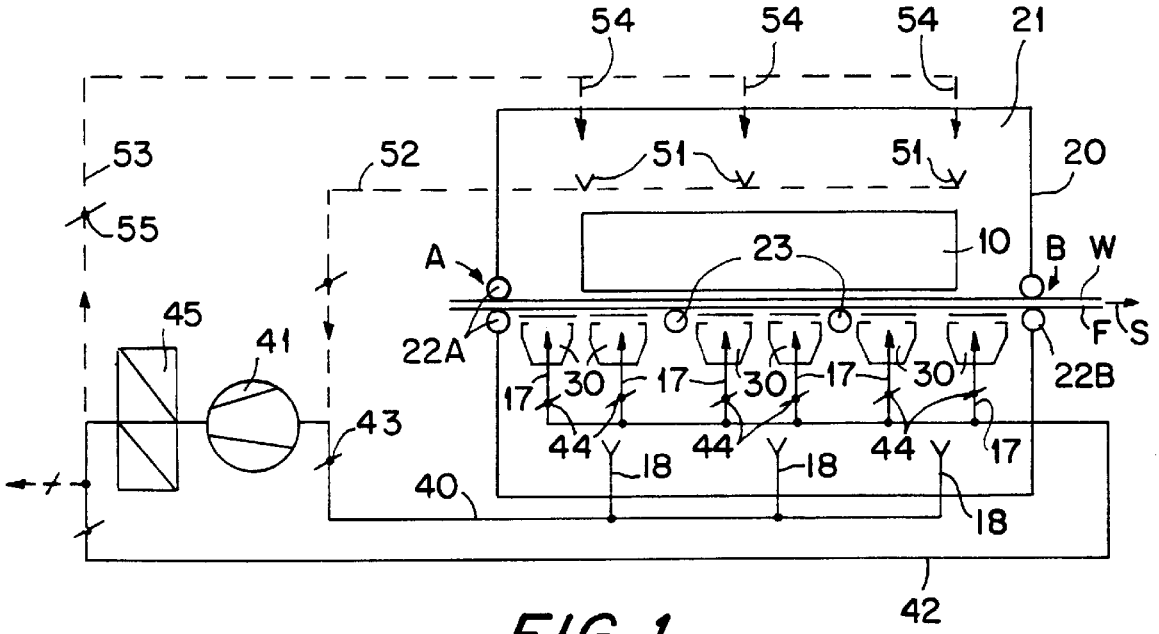
FIG. 1 is a schematic illustration of an arrangement of runnability in accordance with the invention in connection with impingement drying and in which the method in accordance with the invention may be applied.
Figure 2:
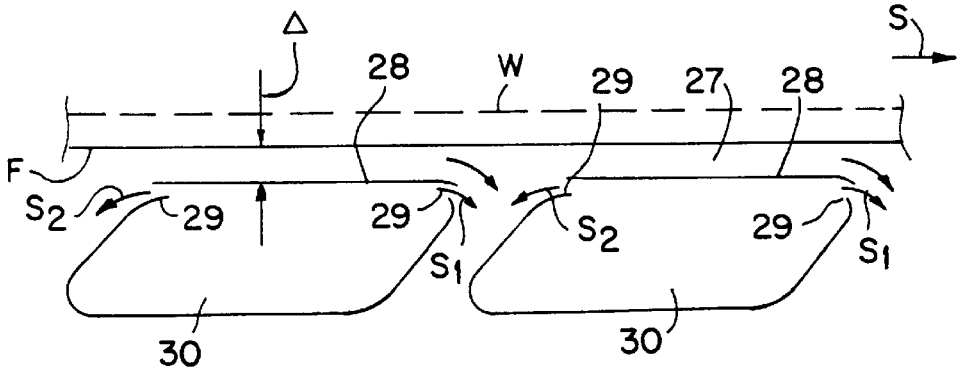
FIG. 2 is a schematic illustration of a group of two blow boxes for use in connection with the arrangement in accordance with the invention.

Referring to FIGS. 1 and 2 wherein like reference numerals refer to the same or similar elements, in the exemplifying embodiment shown in FIG. 1, a paper or material web W is dried by means of an impingement dryer 10, whose surrounding area is enclosed both above the paper web W and below a wire F on which the web W is carried by means of a box, hood or enclosure 20. From the impingement dryer 10, a blow medium which is generally and preferably superheated steam is blown toward the web W which runs on support of the wire F, the wire F supporting the web from below and the steam being blown toward the web from above in this illustrated embodiment. The enclosure 20 forms a closed space 21 which is open at inlet point A, at which the web W enters into the enclosed space 21, and at outlet point B, at which the web W departs from the closed space 21. The points A,B of passage of the web W are provided with support and sealing members 22A,22B.

In the space 21 in the interior of the enclosure 20, a number of vacuum blow devices 30 are arranged underneath the wire F (although this embodiment of the invention requires at least one such vacuum blow device or blow box, a plurality of such devices are shown). As described below, by means of the vacuum blow boxes 30, the run of the wire F and of the web W is stabilized, and thereby the runnability of the web W past the impingement dryer 10 and through the enclosure 20 is improved.

As shown in FIG. 2, steam and/or air jets or blowings $S_1$ are blown out of the blow boxes 30 placed at the side of wire F, i.e., on the side of the web on which the wire F is situated, in a direction substantially in the running direction of the wire F, and the speed of these jets $S_1$ is substantially higher than the speed of the wire F. As is well known, the moving wire F carries steam/air along with it. If the area from which the wire F takes steam/air along with it can be sealed, a vacuum is produced in this area. In the method and apparatus in accordance with the present invention, the sealing is carried out by means of blowings. Since the speed of the jets $S_1$ is higher than the speed of the wire F, an ejection effect is produced which enhances the vacuum produced by the pumping in the wire F. The sealing of the vacuum area in the other direction takes place by means of steam and/or air jets or blowings $S_2$.

By the effect of the vacuum in the area 27 formed between the upper surface or wall of the blow boxes 30 and the wire F, the steam/air in the region above the wire (either between the wire and the web or above the web) attempts to flow through the wire F. Since the web W is practically impenetrable by air, the web W adheres tightly onto the wire F, and no detrimental fluttering occurs. Thus, the blow boxes stabilize the run of the wire F and the web W in the area of the impingement dryer 10 in view of the creation of a vacuum on an opposite side of the wire from the impingement dryer.

In FIG. 1, there are three groups of blow boxes, each having two blow boxes 30 placed one after the other, and in the gaps between the groups, guide rolls 23 are placed. Depending on the geometry of the impingement dryer 10, there can be one or more blow boxes. The blow boxes have a substantially planar (flat) top face or wall 28 which is placed at a distance Δ from the drying wire F that runs facing the face 28. The distance Δ is preferably in the range of from about 5 mm to about 30 mm. At both ends of the planar wall 28 in the blow boxes 30, there are nozzle slots 29 by whose means the blowings $S_1$ and $S_2$ described above are produced (blowing $S_1$ being directed through the first nozzle slot 29 of the blow box in the running direction of the wire F and blowing $S_2$ being directed by the second nozzle slot 29 of the blow box in a direction opposite to the running direction of the wire F). The first nozzle slot is situated at a first end of the upper planar wall 28 and the second nozzle slot is situated at a second end of the upper planar wall 28 opposite the first end thereof. There may also be nozzles at the edges of the blow boxes 30, the access of steam/air between the box and the wire being sealed by means of blowings produced by means of the edge nozzles.

As shown in FIG. 1, several of the blow boxes 30 are situated partially or entirely in opposed relationship to the impingement dryer 10. However, there may also be blow boxes which are not in opposed relationship to the impingement dryer 10.

As shown in FIGS. 1 and 2, the steam needed by the blow boxes 30 is drawn into ducts 18 from the space 21 in the interior of the enclosure 20, preferably from the portion of the enclosure below the wire F in order that disturbing vertical flows should not arise inside the enclosure 20. From the ducts 18, the steam is passed along a duct 40 provided with regulation means such as a regulator 43 to a blower 41 which imparts movement to the steam or other materials removed from the interior of the enclosure 20. By means of the blower 41, at least a portion of the steam is passed along a blow line 42 into each blow device 30 through a respective duct 17. Ducts 17 each include regulation means such as a regulator 44 for regulating the blowing in the respective blow device 30. The blow line 42 can also include a heating device 45, for example a steam heat exchanger or a device for direct supply of steam, in which case a suitable temperature level can be maintained in the interior 21 of the enclosure 20 in order to eliminate any risk of condensation.

By means of the blower 41, it is also possible to draw steam from the interior 21 of the enclosure 20 from the region above the wire F and the web along exhaust ducts 51 and feed pipe 52 and to feed at least a portion of this steam back to this region, after it has been optionally heated, along ducts 53,54. The duct 53 is provided with a regulation member 55 for regulating the quantity of the steam to be supplied to the interior 21 of the enclosure 20. The feed pipe 52 may also be provided with a regulation member 56. When the interior 21 of the enclosure has to be emptied of steam, for example, for servicing of the dryer unit, the enclosure 20 is emptied of steam by means of the blower 41, and similarly, during the start-up stage of the equipment, air can be removed through the blower 41 and the ducts 18,40 from the interior 21 of the enclosure 20.

Above, the invention has been described with reference to an exemplifying embodiment in which steam is used as the drying medium in the impingement dryer 10. The arrangement in accordance with the invention can also be applied, with the principles described above, in arrangements in which hot air or equivalent gaseous or liquid element is used as the drying medium in the impingement dryer unit 10 as well as for the blow medium for the blow boxes 30.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims. For example, a blow jet or blowings as used herein may constitute either a single flow along substantially the entire width of the web or a plurality of flows which combine to extend along substantially the entire width of the web.

I claim:

1. In a method for impingement drying and/or through-drying of a paper or material web in which a blow medium is blown from an impingement drying device in a direction substantially perpendicular to the web to dry the web and the web is passed in contact with a first side of a wire past the impingement drying device, the improvement comprising:

arranging at least one vacuum blow box in opposed relationship to the impingement drying device on a second side of the wire, said at least one blow box having a wall facing the wire to define a space between said wall and the wire, directing first blowings of a blow medium along substantially the entire width of the web from said at least one blow box in an outlet direction which is substantially the same as a running direction of the wire and at a speed substantially greater than the speed of the wire to eject steam and/or air from the space defined between the wire and the wall of said at least one blow box facing the wire, and directing second blowings of the blow medium from said at least one blow box in a direction opposite to the running direction of the wire to seal the space between the wire and the wall of said at least one blow box facing the wire.

2. The method of claim 1, further comprising the step of:

utilizing substantially the same medium as the blow medium for said first and second blowings and for the blow medium for the impingement drying device.

3. The method of claim 2, further comprising the step of:

utilizing superheated steam as the blow medium for said first and second blowings and the blow medium for the impingement drying device.

4. The method of claim 1, further comprising the steps of:

passing the web on support of the wire through a substantially closed space formed within an enclosure, the web and the wire being passed into the enclosure through an inlet point and being passed out of the enclosure through an outlet point, and removing steam from the enclosure from at least one location on the second side of the wire.

5. The method of claim 4, further comprising the steps of:

utilizing the steam removed from the enclosure as the blow medium for said first and second blowings, and utilizing superheated steam as the blow medium for the impingement drying device.

6. The method of claim 1, further comprising the steps of:

passing steam into said at least one blow box to be used as the blow medium for said first and second blowings, heating the steam that is passed into said at least one blow box, and utilizing superheated steam as the blow medium for the impingement drying device.

7. The method of claim 4, further comprising the step of:

controlling runnability of the web and the wire by adjusting the removal of steam and/or air from the space between the wire and the wall of said at least one blow box and from the enclosure such that a vacuum is generated between the wire and the wall of said at least one blow box and causes the web to be pressed against the wire.

8. The method of claim 4, further comprising the steps of:

drawing steam and/or air from a location on the second side of the wire in the enclosure through at least one duct into and through a blower, heating the steam and/or air after said blower, passing a portion of the heated steam and/or air after said blower into said at least one blow box, and utilizing the heated steam and/or air as the blow medium for the impingement drying device.

9. The method of claim 8, further comprising the steps of:

drawing steam and/or air from a location on the first side of the wire in the enclosure through at least one additional duct into and through the blower, and passing a portion of the heated steam and/or air after said blower into at least one location in the enclosure on the first side of the wire.

10. The method of claim 4, further comprising the step of:

emptying the enclosure of steam by means of a blower in a run-down stage.

11. The method of claim 4, further comprising the step of:

removing air from the enclosure by means of a blower during a start-up period.

12. The method of claim 2, further comprising the step of:

utilizing hot air as the blow medium for said first and second blowings and the blow medium for the impingement drying device.

13. In a method for impingement drying and/or through-drying of a paper or material web in which a blow medium of hot air and/or superheated steam is blown from an impingement drying device in a direction substantially perpendicular to the web to dry the web and the web is passed in contact with a first side of a wire past the impingement drying device, the improvement comprising:

arranging a wall extending across substantially the entire width of the web in opposed relationship to the impingement drying device on a second side of the wire, said wall facing the second side of the wire, and generating an area of negative pressure in a space between the wire and said wall to cause the web to be pressed against the wire.

14. The method of claim 13, wherein the step of generating the area of negative pressure comprises the step of directing first blowings of a blow medium along substantially the entire width of the web from a first nozzle arranged at a first end of said wall in an outlet direction which is substantially the same as a running direction of the wire and at a speed substantially greater than the speed of the wire to eject steam and/or air from the space between the wire and said wall.

15. The method of claim 14, further comprising the step of:

sealing the space between the wire and said wall by directing second blowings of the blow medium from a second nozzle arranged at a second end of said wall opposed to said first end of said wall in a direction opposite to the running direction of the wire.

16. The method of claim 15, further comprising the steps of:

passing steam into said at least one blow box to be used as the blow medium for said first and second blowings, and heating the steam that is passed into said at least one blow box.

17. The method of claim 13, further comprising the steps of:

passing the web on support of the wire through a substantially closed space formed within an enclosure, the web and the wire being passed into the enclosure through an inlet point and being passed out of the enclosure through an outlet point, and removing steam from the enclosure from at least one location on the second side of the wire.

18. The method of claim 17, wherein the step of generating the area of negative pressure comprises the step of directing first blowings of a blow medium along substantially the entire width of the web from a first nozzle arranged at a first end of said wall in an outlet direction which is substantially the same as a running direction of the wire and at a speed substantially greater than the speed of the wire to eject steam and/or air from the space between the wire and said wall, further comprising the steps of:

sealing the space between the wire and said wall by directing second blowings of the blow medium from a second nozzle arranged at a second end of said wall opposed to said first end of said wall in a direction opposite to the running direction of the wire, and utilizing the steam removed from the enclosure as the blow medium for said first and second blowings.

19. The method of claim 17, further comprising the step of:

controlling runnability of the web and the wire by adjusting the removal of steam and/or air from the space between the wire and the wall of said at least one blow box and from the enclosure such that a vacuum is generated between the wire and the wall of said at least one blow box and causes the web to be pressed against the wire.

20. The method of claim 17, further comprising the steps of:

drawing steam and/or air from a location on the second side of the wire in the enclosure through at least one duct into and through a blower, heating the steam and/or air after said blower, passing a portion of the heated steam and/or air after said blower into said at least one blow box, and utilizing the heated steam and/or air as the blow medium for the impingement drying device.

21. The method of claim 20, further comprising the steps of:

drawing steam and/or air from a location on the first side of the wire in the enclosure through at least one additional duct into and through the blower, and passing a portion of the heated steam and/or air after said blower into at least one location in the enclosure on the first side of the wire.

* * * * *